US006949985B2

(12) United States Patent
Qiu et al.

(10) Patent No.: US 6,949,985 B2
(45) Date of Patent: Sep. 27, 2005

(54) ELECTROSTATICALLY ACTUATED MICROWAVE MEMS SWITCH

(76) Inventors: Cindy Xing Qiu, 6215 Bienville Street, Brossard, Quebec (CA), J4Z 1W6; Chunong Qiu, 3590 Rue Ovide, Brossard, Quebec (CA), J4Y 2N2; Yi-Chi Shih, 2220 Thorley, Palo Verdes, CA (US) 90274

( * ) Notice: Subject to any disclaimer, the term of this patent is extended or adjusted under 35 U.S.C. 154(b) by 50 days.

(21) Appl. No.: 10/629,162

(22) Filed: Jul. 30, 2003

(65) Prior Publication Data

US 2005/0024161 A1 Feb. 3, 2005

(51) Int. Cl.[7] ..... H01P 1/10; H01P 5/12
(52) U.S. Cl. ..... 333/105; 333/262
(58) Field of Search ..... 333/105, 101, 333/262; 200/181; 257/414, 417; 310/311; 335/78; 342/371; 385/18; 438/52, 694

(56) References Cited

U.S. PATENT DOCUMENTS 6,310,526 B1 * 10/2001 Yip et al. ..... 333/262
6,483,395 B2 * 11/2002 Kasai et al. ..... 333/105
6,496,612 B1 * 12/2002 Ruan et al. ..... 385/18
6,529,093 B2 * 3/2003 Ma ..... 333/101
6,633,212 B1 * 10/2003 Ruan et al. ..... 335/78
6,639,488 B2 * 10/2003 Deligianni et al. ..... 333/101
6,674,141 B1 * 1/2004 Kubena et al. ..... 257/417
6,686,820 B1 * 2/2004 Ma et al. ..... 333/262
6,720,267 B1 * 4/2004 Chen et al. ..... 438/694
6,741,207 B1 * 5/2004 Allison et al. ..... 342/371
6,768,403 B2 * 7/2004 Hsu et al. ..... 335/78
6,798,321 B2 * 9/2004 Hallbjorner ..... 335/78
6,800,503 B2 * 10/2004 Kocis et al. ..... 438/52
6,815,866 B2 * 11/2004 Lee ..... 310/311
6,872,902 B2 * 3/2005 Cohn et al. ..... 200/181

OTHER PUBLICATIONS

H.J. De Los Santos, Y.H. Kao, A.L. Caigoy and E.D. Ditmars, Proc. of IEEE Aerospace Conf., vol. 3, pp. 235–254, no month.

* cited by examiner

*Primary Examiner*—Patrick Wamsley

(57) ABSTRACT

As the basic building block of microwave and millimeter wave units and circuits, the microwave switch must fulfill several requirements including low insertion loss, high isolation and small dimensions. For conventional electrostatically actuated microwave MEMS switches, the isolation between DC and RF is achieved using an RF choke. In this invention, a miniature electrostatically actuated microwave switch with a cantilever and employing two resistive lines on a first substrate and act as the actuation electrodes is provided. The resistive lines as the actuation electrodes according to this invention allows one to minimize the switch dimensions, to facilitate the integration and minimize the interference of the propagating microwave or millimeter wave signals. Another feature of this invention is a miniature electrostatically actuated microwave switch with a cantilever and employing two resistive lines as actuation electrodes on a first substrate, and a third resistive line on a second substrate for the de-actuation of the cantilever.

7 Claims, 11 Drawing Sheets

Prior Art

A – A'

B – B'

ELECTROSTATICALLY ACTUATED MICROWAVE MEMS SWITCH

BACKGROUND OF THE INVENTION

1. Field of Invention

This invention relates to an electrostatically actuated microwave or millimeter wave MEMS switch and switch array. More specifically, it relates to an electrostatically actuated microwave or millimeter wave switch with at least one resistive line to achieve the switch actuation and to achieve the DC to RF isolation simultaneously. It also relates to an electrostatically actuated microwave or millimeter wave MEMS switch with a resistive de-actuation electrode to de-actuate the switch.

2. Brief Description of the Prior Arts

A switch is the basic building block for many microwave and millimeter wave (hereinafter called microwave or RF for simplicity) circuits and units in order to achieve switching and routing of microwaves, generation of phase shift of the microwaves. Examples of applications include microwave switching, routing, phase shifting, beam forming and phase array antennas. Conventional microwave switches are made from semiconductors such as Si or GaAs into field effect transistor or P-I-N form. The semiconductor microwave switches operate based on the non-linear current versus voltage characteristics and have certain advantages including high switching speed, compactness and well developed technologies. However, due to the non-linear current-voltage characteristics and the need to maintain a specific operating point in the On-state, there are several drawbacks. The drawbacks of the semiconductor microwave switches include: [1] signal distortion, [2] relatively large insertion loss and [3] high DC power consumption in On-state.

In order to develop a new generation of microwave systems for communications and phased arrays, extensive work has been carried out on the development of miniature mechanical switches based on micro-electro-mechanical technology (herein after call MEMS technology). The MEMS technology for the fabrication of microwave switches can be categorized as those based on electromagnetic force actuation and those on electrostatical force actuation. Several authors have disclosed microwave MEMS switch structures based on electromagnetic actuation. Examples are U.S. Pat. No. 6,016,092 entitled "Miniature Electromagnetic Microwave Switches and Switch Arrays" and U.S. Pat. No. 6,310,526 B1 entitled "Double-throw Miniature Electromagnetic Microwave Switches" by the present inventors.

The efforts on electrostatically actuated microwave MEMS switches are even more extensive [H. J. De Los Santos, Yu-Hua Kao, A. L. Caigoy and E. D. Ditmars, "Microwave and Mechanical Considerations in the Design of MEM Switches for Aerospace Applications", Proceedings of IEEE Aerospace Conference, Vol. 3, pp. 235–254, 1997]. The main advantage of the electrostatically actuated microwave MEMS switches is the avoidance of the electromagnetic coils for the actuation of the switches. FIGS. 1(*a*), 1(*b*) and 1(*c*) show schematic diagrams of a conventional electrostatically actuated microwave MEMS switch (1). On a dielectric substrate (2), an input transmission line (3) and an output transmission line (4) are created for the transmission of microwave signals. There is a gap (5) with a length of ($L_{gap}$, in FIG. 1(*c*)), separating the input transmission line (3) and the output transmission line (4). A movable contact pad (6) with a length of $L_{pad}$ is suspended over and covers parts of the input and output transmission lines (3, 4). Two inner supports (8, 9), which are parts of a dielectric membrane (9', in FIGS. 1(*b*) and 1(*c*)), are used to connect the contact pad (6) to two actuation top electrodes (10, 11). These two actuation top electrodes (10, 11) are further connected through two outer supports (12, 13, in FIG. 1(*a*)) to two anchors (14, 15). The two anchors (14, 15) are finally connected to the substrate (2). It is noted that the inner supports (8, 9) are electrically insulating so that the propagating microwave signals along the input transmission line (3) and the output transmission line (4) when the switch is actuated will not be affected by the prescribe of the actuation top electrodes (10, 11). On the actuation top electrodes (10, 11), the outer supports (12, 13) and the anchors (14, 15), there is a layer of metal (16,17) for connecting actuating voltage to the actuation top electrodes (10, 11). Under the actuation top electrodes (10, 11), two actuation bottom electrodes (18, 19) are deposited directly below the actuation top electrodes (10, 11). These actuation bottom electrodes (18, 19) are connected through conductors (20, 21) to bottom connecting pads (22, 23). When a DC voltage is applied between the actuation top electrodes (10, 11) and the actuation bottom electrodes (18, 19), electrostatic forces induced will actuate the movable contact pad (6) towards the overshadowing portions of the input transmission line (3) and the output transmission line (4) and causing a short circuit between the two. Microwave signals propagating from the input transmission line (3) now can reach the output transmission line (4). In the above-described structure, in order to reduce the interference of the propagating microwave signals due to the presence of the actuation top electrodes (10,11), the length ($L_s$) of the inner supports (8, 9) must be sufficiently large. Hence, the mechanical strength of the inner supports (8, 9) may not be sufficient to maintain the gap (24) between contact pad (6) and the input and output transmission lines (3, 4). Furthermore, after the actuation of the contact pad (6), there may be an attracting force between the contact pad (6) and the input and output transmission lines (3, 4). This will make de-actuating of switch (1) to be difficult when the DC power source is switched off.

In order to reduce the above-mentioned drawbacks, there is an alternate microwave switch structure (30) proposed as shown in FIGS. 2(*a*) and 2(*b*), where the connection between input transmission line (31) and output transmission line (32) on a substrate (33) is achieved by a movable contact pad (34), which is connected electrically to two anchors (35, 35') through two supports (36, 36'). One of the anchors (35, 35') is connected to a contact pad (37). Under the movable contact pad (34), there is an actuation bottom electrode (38), which is connected through a conductive connecting line (39) to a connecting pad (40). The advantage of this structure (30) is the improved mechanical properties. However, since the movable contact pad (34) and the actuation bottom electrode (38) are connected directly to the DC power supply through connecting pads (37, 40), there will be significant loss of the propagating microwave signals. In order to minimize the un-wanted microwave loss, RF chokes (41, 42) are added between the DC power supply and the movable contact pad (34), and between the DC power supply and the actuation bottom electrode (38). The required RF chokes (41, 42) are often bulky and still may lead to interference of the propagating microwaves.

From the above descriptions, it is evident that microwave units or switches can be simplified further if an electrostatically actuated microwave MEMS switch can be provided without the need of the RF chokes and yet to achieve effective isolation between the DC power source and the propagating RF signals. In this invention, an electrostatically actuated MEMS switch structure without the need of the RF chokes to achieve both the actuation and the effective isolation between the DC power source and the propagating microwave signals is provided.

SUMMARY OF THE INVENTION

The present invention provides novel electrostatically actuated MEMS switches and switch arrays for microwave communications.

In one embodiment of this invention, an electrostatically actuated microwave MEMS switch with thin film resistive electrodes to achieve actuation and DC/RF isolation simultaneously is disclosed. This switch consists of an input transmission line and an output transmission line with a freestanding cantilever connected to the input transmission line and suspending over part of the output transmission line. In order to attract the cantilever to make contact with the output transmission line, two resistive actuation electrodes are built. The first actuation electrode is located underneath the freestanding cantilever and between the input transmission line and the output transmission line, whereas the second actuation electrode is connected to the input transmission line. When a DC power source, connected between the actuation electrodes, is turned on, the voltage applied across the actuation electrodes will induce opposite charges on the freestanding cantilever and the first actuation electrode beneath the freestanding cantilever, which causes the freestanding cantilever to move downwards and get in contact with the output transmission line.

In another embodiment of this invention, a method to control the resistivity or sheet resistance and dimensions of the actuation electrodes in an electrostatically actuated microwave MEMS switch is disclosed to achieve good DC to RF isolation and to control the switching time.

In yet another embodiment, an electrostatically actuated microwave MEMS switch with a dielectric layer on top of the first actuation electrode is disclosed. This layer is introduced to avoid un-wanted contact between the freestanding cantilever and the first actuation electrode when the DC power source is turned on.

In yet another embodiment, an electrostatically actuated microwave MEMS switch with a recess region in the freestanding cantilever in area overlapping the output transmission line is disclosed. This recess region is introduced in order to ensure proper electrical contact between the freestanding cantilever and the output transmission line when actuated.

In still another embodiment, an electrostatically actuated microwave MEMS switch with a de-actuation electrode is disclosed. This de-actuation electrode is deposited on a second substrate and situated at a position over the freestanding cantilever to de-actuate the freestanding cantilever during switching from an On-state to an Off-state.

In still another embodiment of the present invention, an electrostatically actuated microwave single-pole-double-throw MEMS switch with resistive actuation electrodes and de-actuation electrodes are disclosed.

DETAILED DESCRIPTION OF THE PREFERRED EMBODIMENTS

Figure 1A:
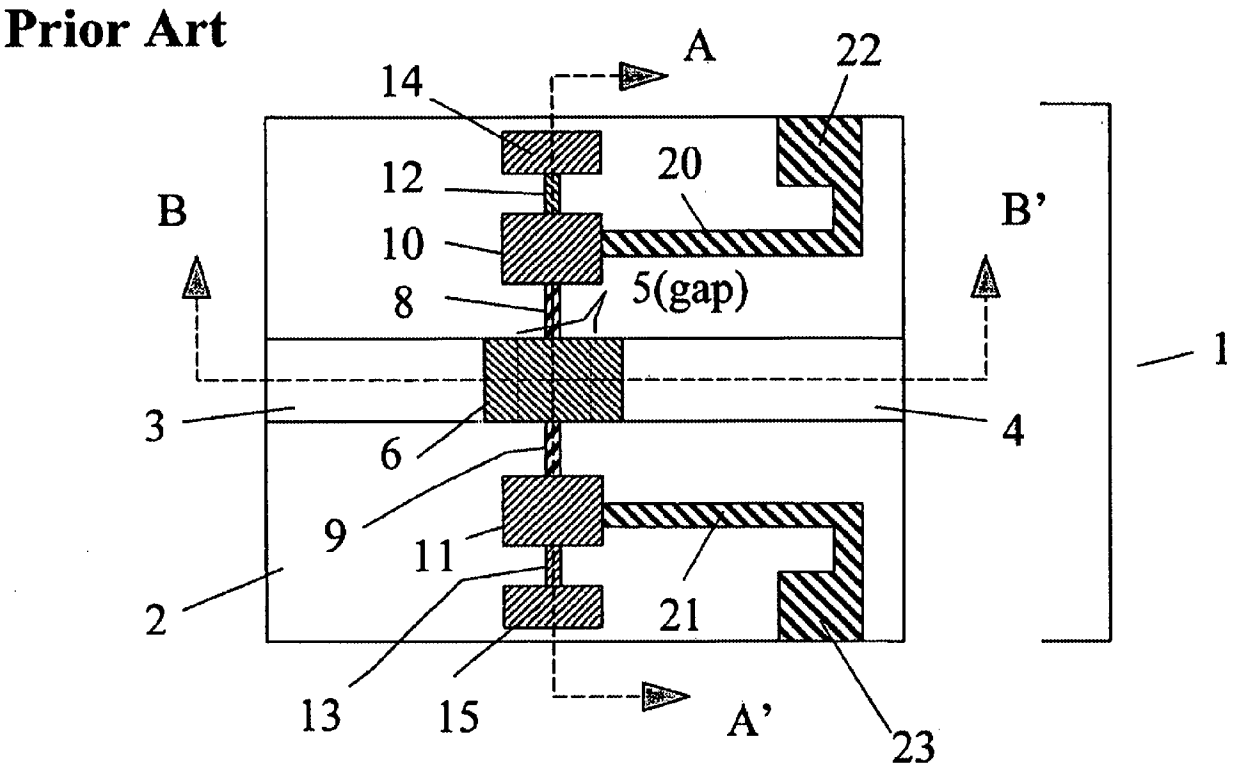
FIGS. 1(*a*), (*b*) and (*c*) show schematically the structure of a conventional electrostatically actuated microwave MEMS switch (1) using dielectric membranes to achieve the isolation between the DC power source and propagating microwave signals.
Figure 1B:
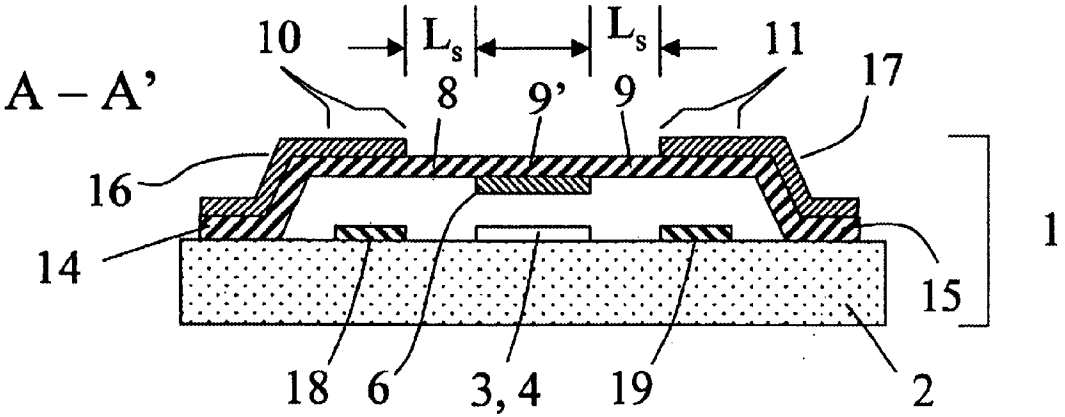
Fig. 1(b) Prior Art
Figure 1C:
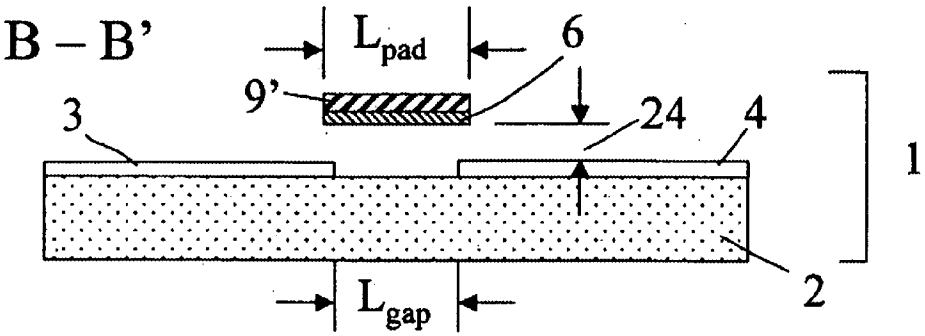
Figure 2A:
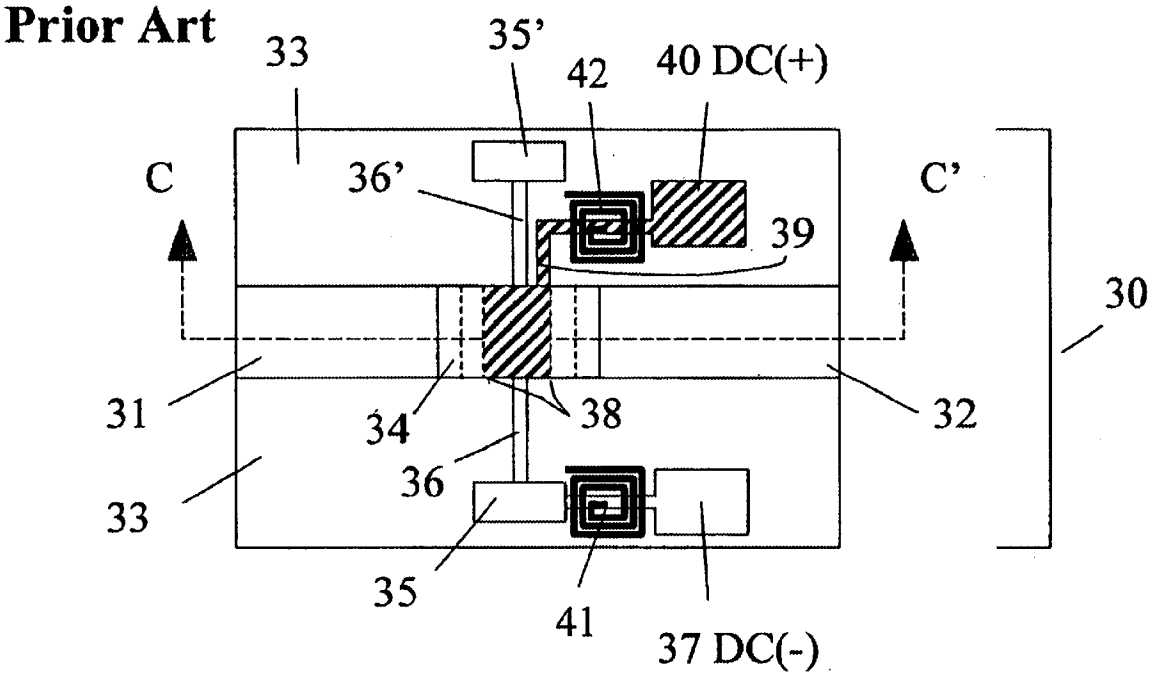
Prior Art Fig. 2(a)
FIGS. 2(*a*) and (*b*) show schematically the structure of a conventional electrostatically actuated microwave MEMS switch (30) with RF chokes to achieve the DC and RF isolation.
Figure 2B:
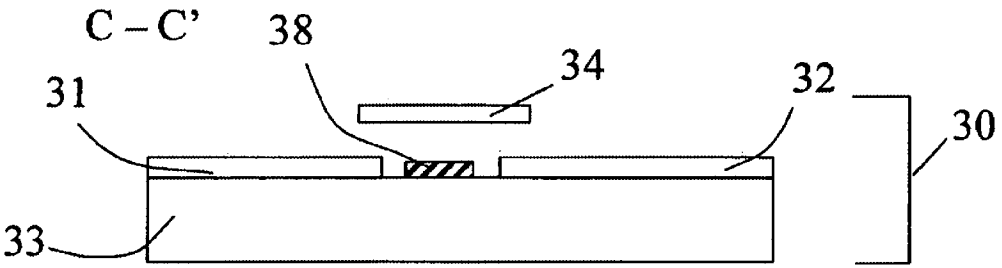
Prior Art Fig. 2(b)
Figure 3A:
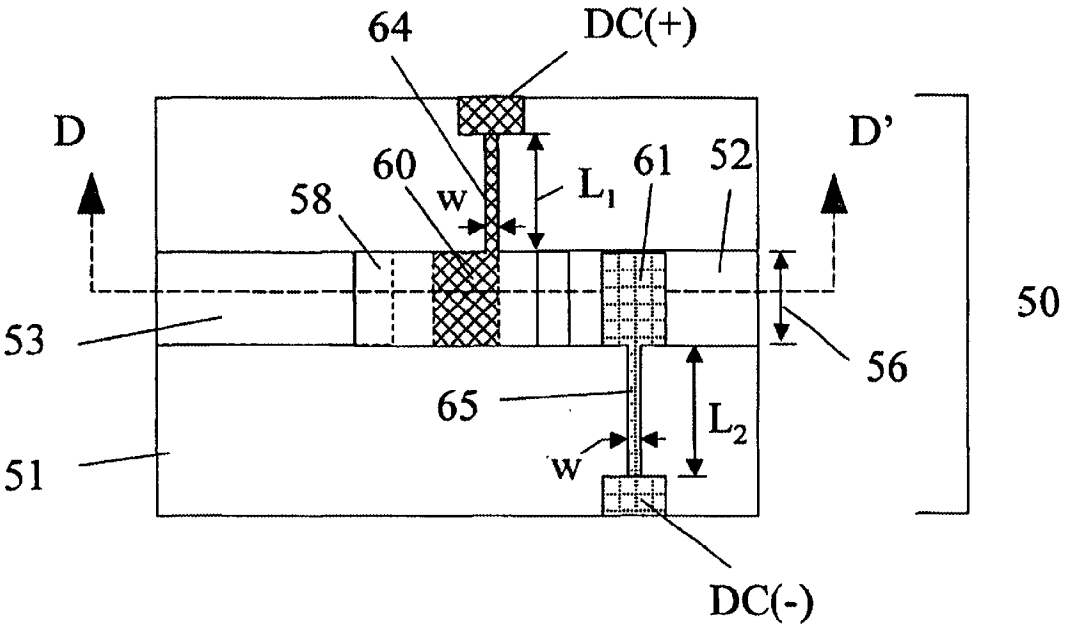
FIGS. 3(*a*) and (*b*) show the schematic top and side views of the novel electrostatically actuated microwave MEMS switch (50) with resistive lines to achieve both the actuation and the isolation between the DC power,source and the propagating microwave signals according to this invention.
Figure 3B:
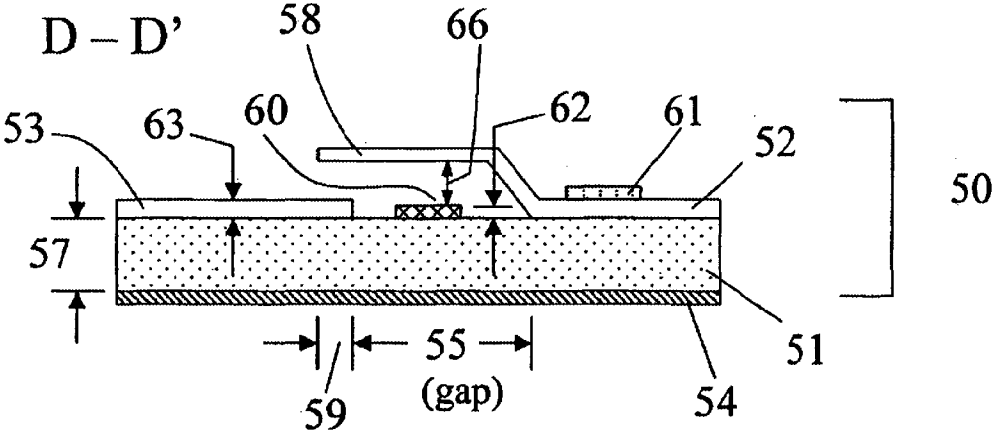

1. RF MEMS Switch with Resistive Actuation Electrode Lines:

According to one embodiment of this invention, an electrostatically actuated microwave (RF) MEMS switch (50) as shown in FIGS. 3(*a*) and (*b*) consists of a first dielectric substrate (51), with an input transmission line (52) and an output transmission line (53) on the front surface of (51) aid a ground metal layer (54) on the back surface of (51) (with a microstrip switch structure) is provided. It is noted that in the present microwave MEMS switch, the input transmission line (52) and the output transmission line (53) are interchangeable in terms of the propagation of microwave or millimeter wave signals. It is further noted that the ground metal layer (54) may be deposited on the front surface of the dielectric substrate (51) at a distance from the input transmission line (52) and the output transmission line (53), forming a co-planar waveguide switch structure. There is a gap (55) between the input transmission line (52) and the output transmission line (53). The width (56) of the transmission lines (52, 53) is selected according to the thickness (57) of the substrate (51) and its dielectric constant in order to yield specific impedance, for instance 50 ohms. A freestanding cantilever (58) connected to the input transmission line (52) extends over the output transmission line (53) with an overlap region (59) to allow for contact between the input transmission line (52) and output transmission line (53) when the freestanding cantilever (58) is attracted (actuated) by a first resistive actuation electrode (60) (hereinafter called the first actuation electrode for simplicity) underneath the freestanding cantilever (58) and located between the input transmission line (52) and output transmission line (53). When the freestanding cantilever is not actuated, the microwave or millimeter signals will not be allowed to travel from the input transmission line (52) to the output transmission line (53). To achieve the actuation of the freestanding cantilever (58), connected to the input transmission line (52), to get in contact with the output transmission line (53), a second resistive actuation electrode (61) (hereinafter called the second actuation electrode for simplicity) is connected to the input transmission line (52). It is noted that the first actuation electrode (60) is not connected electrically either to the input transmission line (52) or the output transmission line (53).

A DC power source is connected between the first actuation electrode (60), through a first actuation electrode line (64), and the second actuation electrode (61), through a second actuation electrode line (65). When the DC power source is turned on, the voltage applied across the first actuation electrode (60) and the second actuation electrode (61) will induce opposite charges on the bottom surface of the freestanding cantilever (58) and the top surface of the first actuation electrode (60) underneath the freestanding cantilever (58). The opposite charges attract each other to cause the attraction force between the first actuation electrode (60) and the freestanding cantilever (58), causing the freestanding cantilever (58) to move downwards and to get in contact with the output transmission line (53). This will allow the microwave or millimeter wave signals to travel from the input transmission line (52) to the output transmission line (53). It is noted that in order to avoid DC shorting between the first resistive actuation electrode (60) and the second actuation electrode (61), it is preferable to have the first actuation electrode (60), at least in the overlapped region, with a thickness (62) less than the thickness (63) of the output transmission line (53). Hence, when the freestanding cantilever (58) is actuated, it will make electrical contact with the output transmission line (53) but not with the first actuation electrode (60).

According to another embodiment of this invention, in order to achieve isolation between the DC power source and the propagating microwave signals and to maintain the capability of actuation of the freestanding cantilever (58), the resistivity or sheet resistance of the first actuation electrode line (64) and the second actuation electrode line (65) need to be controlled. The sheet resistance is defined as the resistance per square of the electrode line material and may be conveniently used in the present description. (It should be noted that in prior art MEMS switch (30) with conductive electrode lines (36, 39), two RF chokes (41, 42) must be employed in order to minimize the interference to the microwave or millimeter wave signals.) When the sheet resistance of the first actuation electrode line (64) and the second actuation electrode line (65) is substantially greater than the characteristic impedance of the input transmission line (52) and the output transmission line (53) (for example 50 ohms), the effect of interference on the propagating microwave signals due to the presence of these actuation electrodes (60, 61) and actuation electrode lines (64, 65) could be minimized. For instance, when the sheet resistance of the first actuation electrode line (64) and the second actuation electrode line (65) is 200 ohm per square, the difference between the forward transmission of the transmission lines (52, 53) with and without these actuation electrodes lines (64, 65) is about 0.49 dB at 10 GHz. When the sheet resistance is increased from 200 ohm per square to 10,000 ohms per square, the difference between the forward transmission of the transmission lines (52, 53) with and without these actuation electrode lines (64, 65) is reduced from about 0.49 dB to 0.02 dB. Hence, it becomes clear that the loss of the propagating microwaves due to the adoption of the first actuation electrode line (64) and the second actuation electrode line (65) can be reduced by increasing their sheet resistance.

However, the sheet resistance cannot be increased indefinitely. This is due to the required delay time for charging and discharging the charges for actuation. The charging and discharging delay time is determined by the total resistance between the two terminals of the DC power source and the capacitance between the freestanding cantilever (58) and the first actuation electrode (60), namely, the RC time constant. If the sheet resistance of the first actuation electrode (60), the first actuation electrode line (64), the second actuation electrode (61) and the second electrode line (65) is increased to too high a value, the RC time constant will be too large which will lead to a slow actuation speed.

It is noted that the total resistance between the two terminals of the DC power source is equal to the product of the sheet resistance of actuation electrode lines (64, 65) and the total length-to-width ratio (L1+L2)/W of the two actuation electrode lines (64, 65). For an average capacitance between the freestanding cantilever (58) and the first actuation electrode (60) of 0.118 pF (assuming the average separation (66) between the bottom surface of the freestanding cantilever (58) and the top surface of the first actuation electrode (60) to be 3 $\mu$m and an overlapped area of the two (60, 58) to be 200 $\mu$m×200 $\mu$m) and a total resistance between the two terminals of the DC power source of 100 kΩ, the RC time constant is equal to 11.8 nanoseconds. By controlling the separation (66) and overlapped area between the freestanding cantilever (58) and the first actuation electrode (60), the sheet resistance and the total length ($L_1$+$L_2$) to width (W) ratio of the actuation electrode lines (64, 65), the RC time constant of the charging and discharging can be conveniently controlled.

Possible materials for the construction of the resistive layers for-the actuation electrodes (60, 61) and actuation electrode lines (64, 65) include but not limited to metal oxides or nitrides such as: indium tin oxide (ITO), zinc oxide (ZnO), tin oxide ($SnO_2$) and metals such as: tantalum (Ta). These resistive materials can be deposited on a substrate by vacuum evaporation or sputtering to a thickness from less than 100 nm to several $\mu$m. For the microwave MEMS switches according to this invention, it is preferable to control the thickness of the resistive layers to be less than the thickness of the transmission lines. The resistivity or sheet resistance of the metal oxides can be controlled over, a large range by controlling the deposition rate, oxygen content and substrate temperature during the deposition.

Figure 4:
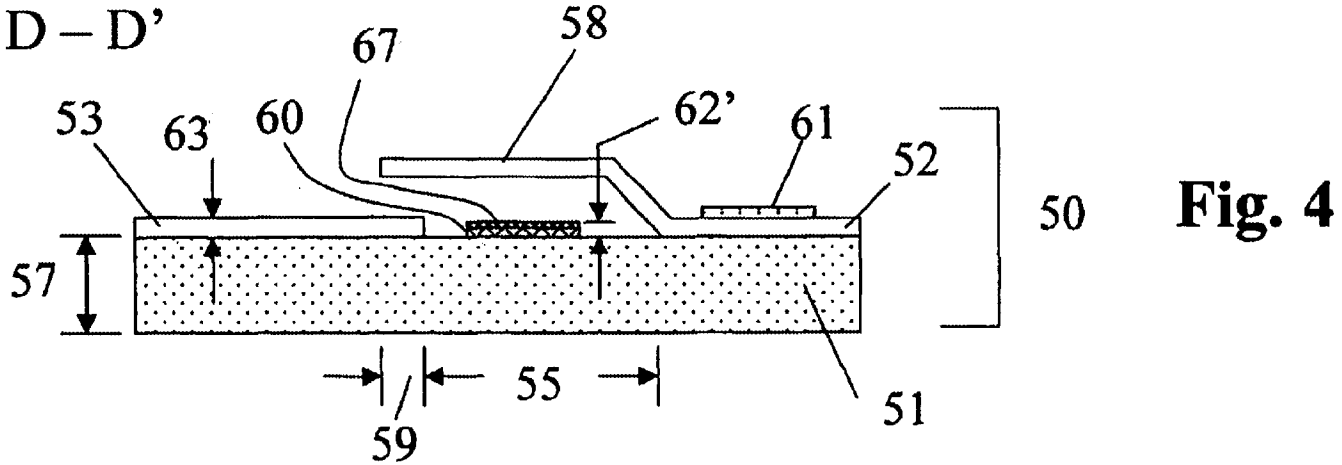
FIG. 4 is a schematic side view of the novel electrostatically actuated microwave MEMS switch (50) with a dielectric layer on top of the resistive line of the first actuation electrode to prevent DC shorting between the first actuation electrode and the freestanding cantilever when actuated.

According to yet another embodiment of this invention, in order to avoid un-wanted DC contact between the freestanding cantilever (58) and the first actuation electrode (60) when the DC power source is turned on, it is preferable to introduce a first dielectric layer (67) immediately on top of the first actuation electrode (60) at least over the overlapped region between the freestanding cantilever (58) and the first actuation electrode (60), as shown in FIG. 4., The total thickness (62') of the first dielectric layer (67) and the first actuation electrode (60) should be smaller than the thickness (63) of the output transmission line (53), so that the first dielectric layer (67) and the first actuation electrode (60) will not interfere with the motion of the freestanding cantilever (58) when actuated and with a high enough breakdown field in order to withstand the DC voltage applied by the DC power source. Possible dielectric materials for the first dielectric layer (67) include but not limited to: silicon dioxide, silicon nitride, tantalum oxide, tantalum nitride and certain high dielectric constant materials such as barium strontium titanate (BST). When the freestanding cantilever (58) is actuated by the application of an actuation voltage to the actuation electrodes (60, 61) from the DC power source, the freestanding cantilever (58) will get in contact with the output transmission line (53) to allow the microwave signals to propagate from the input transmission line (52) to the output transmission line (53). The presence of the first dielectric layer (67) will prevent the risk of the freestanding cantilever (58) making direct electrical contact With the first actuation electrode (60).

Figure 5:
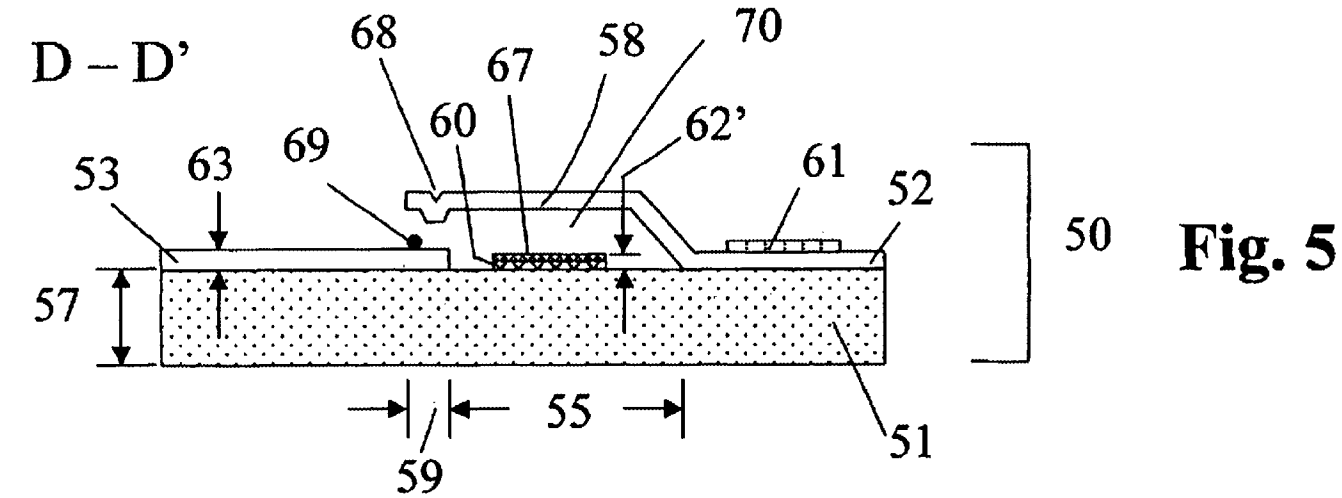
FIG. 5 is a schematic side view of the electrostatically actuated microwave MEMS switch (50) shown in FIG. 4, with a recess region created in the leading part of the cantilever in region overlapping the output transmission line in order to improve the electrical contact when the switch (50) is actuated.

In order to ensure proper electrical contact between the freestanding cantilever (58) and the output transmission line (53) when actuated, for the microwave MEMS switch (50) with the resistive actuation electrodes (60, 61), it is preferable to have a recess region (68) built in the freestanding cantilever (58) in area overlapping with the output transmission line (53). As shown in FIG. 5, the recess region (68) created in the freestanding cantilever (58) will make the first contact with the output transmission line (53) when actuated. Hence, even with the un-wanted presence of small particles (69) under the freestanding cantilever (58), contact will be established between the freestanding cantilever (58) and the output transmission line (53) through recess region (68), when actuated.

2. RF MEMS Switches with a De-actuation Device:

In conventional electrostatically actuated microwave MEMS switches, electrostatic force is used to actuate a freestanding cantilever (or a membrane) by applying a voltage to cause electrical contact and to switch the switch to the On-state. To restore the Off-state, the applied DC voltage is switched off and the switch relies on the spring force of the cantilever or membrane to return to the Off-state where the cantilever (or membrane) is raised to a freestanding position away from the output transmission line (or from both the input and the output transmission lines). In the case of a cantilever-type switch like (50), immediately after the switching-Off of the applied DC voltage, air will have to flow into and fill the gap (70, in FIG. 5) below the cantilever (58). This often causes a delay in switching time and sometimes even prevents the cantilever from being raised by the spring force. There is also a situation where an attraction between the cantilever (58) and the output transmission line (53) occurs due to a van der Wall force when actuated. Under such conditions, it will be difficult for the cantilever or membrane to restore to the freestanding position without additional external restoring force.

Figure 6A:
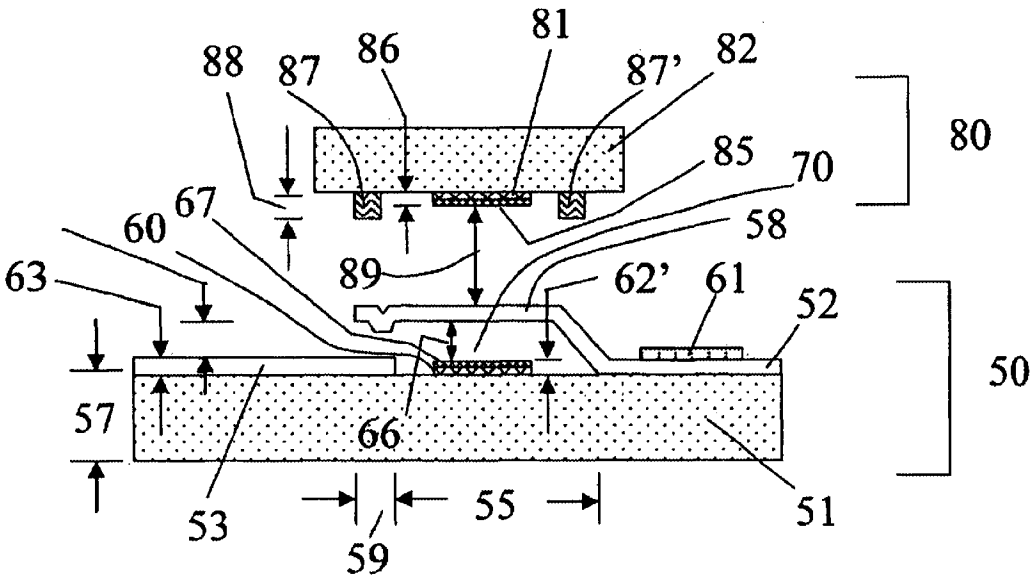
FIG. 6(*a*) shows the schematic side view of the novel electrostatically actuated microwave MEMS switch (50), with a de-actuation device (80) to de-actuate the cantilever, and (*b*) illustrates the structure of the de-actuation device (80).
Figure 6B:
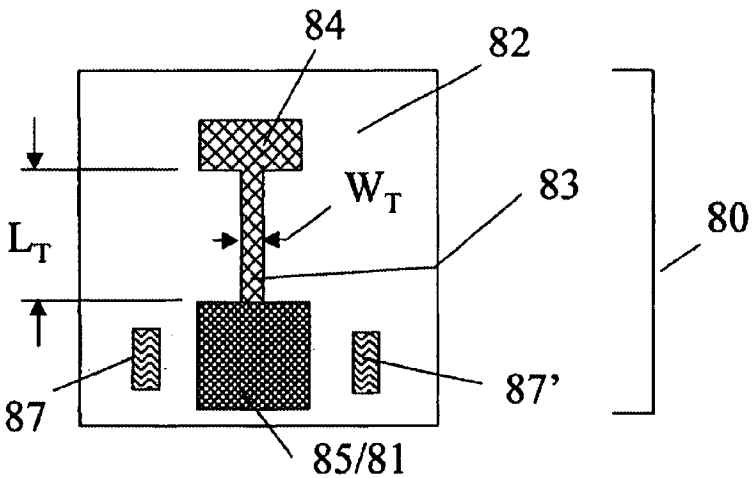

Hence, according to still another embodiment of the present invention, as shown in FIGS. 6(*a*) and (*b*), a de-actuation device (80) is added to switch (50) and is disclosed to de-actuate the switch (50). In FIG. 6(*a*), all numbered elements illustrated in element (50) have the same meaning as the ones depicted in FIGS. 5(*a*) and 5(*b*). In this de-actuation device (80), a third de-actuation electrode (81) is deposited on a second substrate (82) in order to de-actuate the freestanding cantilever (58) during switching from an On-state to an Off-state. The third de-actuation electrode (81) is aligned and mounted facing the cantilever (58), which is fabricated and supported by the first substrate (51). To de-activate the microwave MEMS switch (50), the voltage applied between the first actuation electrode (60) and the second actuation electrode (61) is switched off and a second voltage is applied between the second actuation electrode (61), which is connected to the input transmission line (52), and the third de-actuation electrode (81) through a third de-actuation electrode line (83), both (81) and (83) are deposited on the second substrate (82). An electrostatic force will be induced between the cantilever (58) and the third de-actuation electrode (81), causing the cantilever (58) to break free from the contact with the output transmission line (53). Consequently, the electrostatically actuated microwave MEMS switch (50) can be de-activated without the limitation of the van der Wall force or the airflow problem.

In order to reduce the RC time constant and to minimize the interference of the presence of the third de-actuation electrode (81) and the third de-actuation electrode line (83) on the propagating microwave signals, the sheet resistance of the third de-actuation electrode line (83) must be controlled. This third de-actuation electrode line (83) is connected to the DC power source through a third connecting pad (84). According to this invention, it is preferable to control the sheet resistance of the third de-actuation electrode line (83) to be similar to that of the first actuation electrode line (64) and the second actuation electrode line (65). Hence, the resistance of the third de-actuation electrode line (83) is equal to the product of the sheet resistance and the ratio of length ($L_T$) to width ($W_T$), $L_T/W_T$. Furthermore, in order to avoid DC shorting between the cantilever (58) and the third de-actuation electrode (81), a layer of second dielectric material (85) is deposited on the surface of overlapping region of the third de-actuation electrode (81) facing the cantilever (58). Therefore, when the cantilever (58) is de-actuated, it moves towards the third de-actuation electrode (81) but will stop when it touches the second dielectric material (85) and will not cause a DC shorting to the third de-actuation electrode (81). The total thickness (86) of the second dielectric layer (85) and the third de-actuation electrode (81) should be small enough so that it will not interfere with the motion of the freestanding cantilever (58) when de-actuated and with a high enough breakdown field in order to withstand the DC voltage applied by the DC power source. Possible dielectric materials for (85) include but not limited to: silicon dioxide, silicon nitride, tantalum oxide, tantalum nitride and certain high dielectric constant materials such as barium strontium titanate. In addition, in order to prevent the un-wanted adhesion of the cantilever (58) to the third de-actuation electrode (81), dielectric stoppers (87, 87') may be fabricated on the two sides of the third de-actuation electrode (81). The thickness (88) of the stoppers (87, 87') should be greater than the total thickness (86) of the third de-actuation electrode (81) and the second dielectric layer (85) in order to avoid direct contact between the cantilever (58) and the second dielectric layer (85). To actuate the switch (50), the DC voltage applied between the second actuation electrode (61) and the third de-actuation electrode (81) is switched off and a DC voltage applied between the first actuation electrode (60) and the second actuation electrode (61) is switched on. In order to operate this microwave MEMS switch (50) with a single power source, it is preferable to have a separation (89) between the third de-actuation electrode (81) and the freestanding cantilever (58) to be smaller compared to the separation (66) between the cantilever (58) and the first actuation electrode (60). In this manner, the magnitude of the actuation voltage and that of the de-actuation voltage will be approximately the same.

3. Single-pole-double-throw RF MEMS Switches:

According to still another embodiment of this invention, a microwave switch array is provided by combining at least two electrostatically actuated microwave MEMS switches (50) with resistive actuation electrodes. The integration may be achieved using lithography and etching method to form a plurality of input transmission lines with cantilevers, output transmission lines, first resistive actuation electrodes and second actuation electrodes. The input transmission lines and output transmission lines may be connected in a specific way to achieve the required switching and processing of microwave signals. In addition, the first actuation electrode and the second actuation electrode of one switch may be connected to actuation electrodes of other switches forming the switch array, in order to facilitate the switching and processing of the propagating microwave and millimeter wave signals.

Figure 7A:
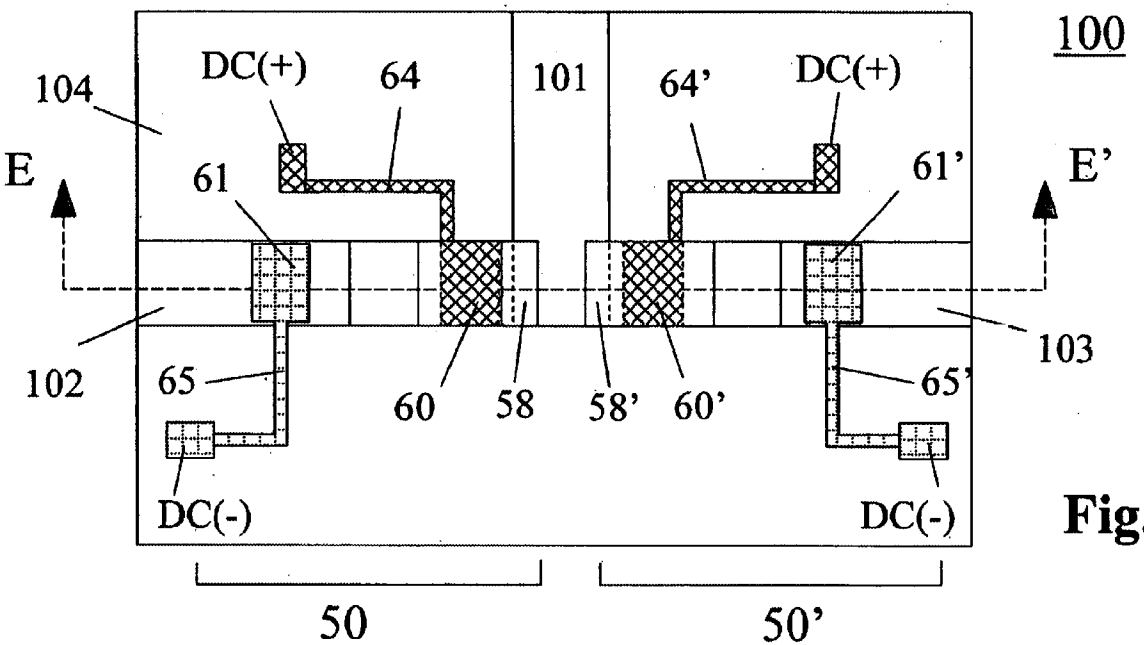
FIG. 7(*a*) is a schematic top view of an electrostatically actuated single-pole-double-throw microwave MEMS switch (100) with resistive lines to achieve actuation and DC/RF isolation, and (*b*) shows the side view of the same switch (100).
Figure 7B:
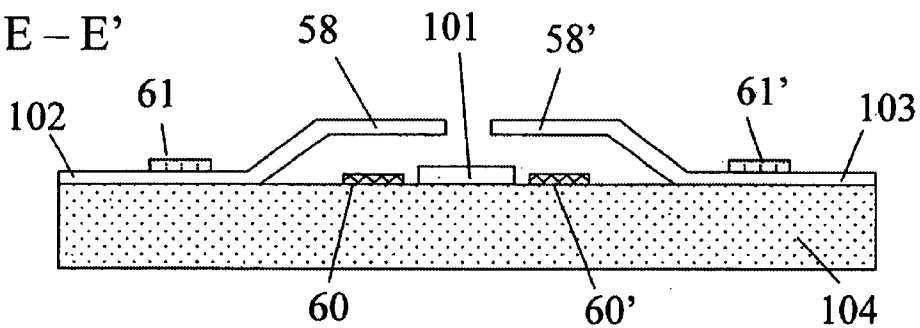

For illustration purposes, a simple example of such a microwave switch array in a single-pole-double-throw switch (100) form, as illustrated in FIG. 7, is provided by a first and a second electrostatically actuated microwave MEMS switches (50 and 50'). It should be mentioned that this example is provided for illustration purposes and not to limit the scope of this invention. This single-pole-double-throw switch (100) consists of an input transmission line (101), a first output transmission line (102) and a second output transmission line (103) fabricated on a first dielectric substrate (104). A first cantilever (58) and a second cantilever (58') are created to suspend over one end of the input transmission line (101) with the first cantilever (58) connected to the first output transmission line (102) and the second cantilever (58') connected to the second output transmission line (103). In this single-pole-double-throw switch (100), two pairs of actuation electrodes (60, 61 and 60,' 61') are built for switching separately the two microwave MEMS switches (50, 50').

When a DC actuation voltage is applied between the first actuation electrode (60) and the second actuation electrode (61) of the first switch (50) through actuation lines (64, 65), cantilever (58) will be attracted downward and will make contact with the input transmission line (101). Since the two switches (50, 50') are controlled separately, while the first output transmission line (102) is connected to the input transmission line (101) through actuated cantilever (58), the second output transmission line (103) is not connected to the input transmission line (101). Therefore, microwave signals will prorogate from the input transmission line (101) to the first output transmission line (102) and not to the second output transmission line (103). Similarly, when the DC actuation voltage to the first switch (50) are switched off and a second DC actuation voltage is applied between the first actuation electrode (60') and the second actuation electrode (61') of the second switch (50') through actuation lines (64', 65'), the second cantilever (58') will be attracted toward the input transmission line (101) and make contact with it. Since the two switches (50, 50') are controlled separately, while the second output transmission line (103) is connected to the input transmission line (101) via the actuated second cantilever (58'), the first output transmission line (102) is not connected to the input transmission line (101). Therefore, microwave signals will prorogate from the input transmission line (101) to the second output transmission line (103) and not to the first output transmission line (102).

To switch off any of the switches (50, 50') in the above-described single-pole-double-throw switch (100) and to avoid the switching time delay relying on the spring force or cantilever sticking due to the van der Wall force, a de-actuation device (80) shown in FIGS. 6(*a*) and (*b*) may well be fabricated for each switch (50, 50') to de-actuate the switches (50, 50'). In this case, two de-actuation devices (80, in FIG. 6)) may be fabricated on a same second substrate (82 in FIG. 6) with spacing equal to the spacing between the first cantilever (58) and the second cantilever (58') so that these two de-actuation devices (80, 80') can be aligned over the cantilevers (58, 58') to de-actuate them.

Figure 8B:
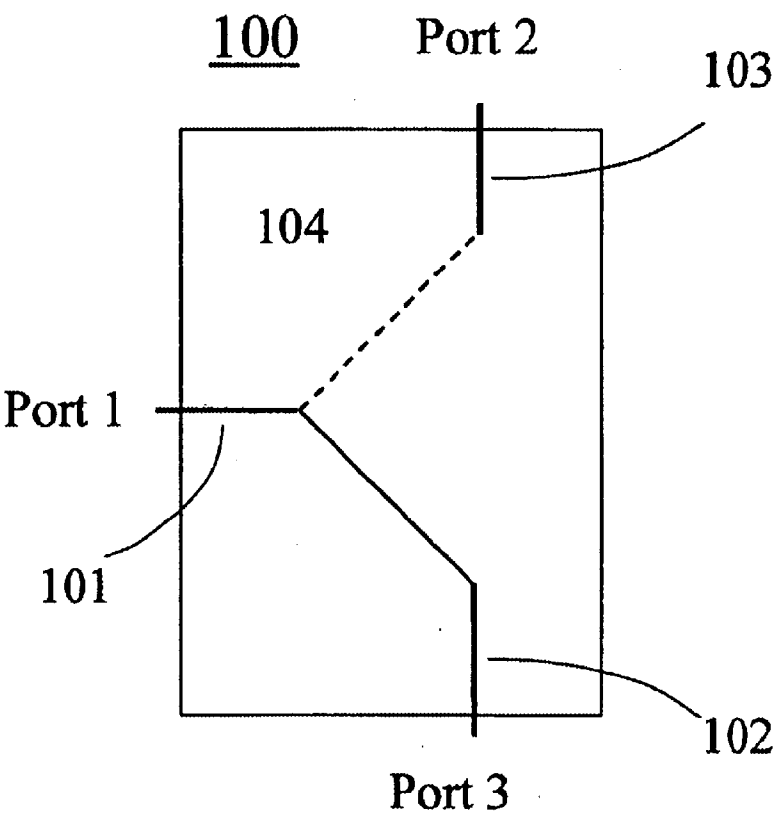
FIG. 8 shows figuratively an electrostatically actuated single-pole-double-throw microwave MEMS switch (100) described in FIG. 7.
Figure 8A:
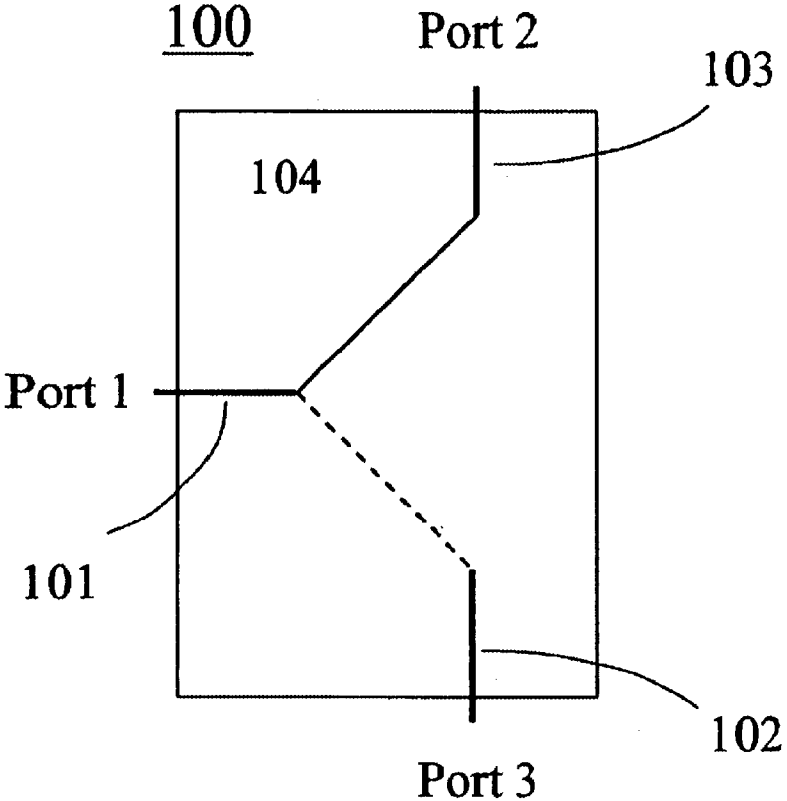

For the purpose of description, a single-pole-double-throw switch (100) is illustrated figuratively in FIG. 8(*a*), in which the switch (100) is represented by Port 1, the input transmission line (101), Port 2, the second output transmission line (103) and Port 3, the first output transmission line (102). The actuation electrodes are not shown in this simplified illustration. The functionality of the switch (100), when switch (50, in FIG. 7(*a*)) is in Off-state and switch (50') is in On-state, is illustrated by a solid line from Port 1 to Port 2 and a broken line from Port 1 to Port 3. When switch (50') is in On-state and switch (50) is in Off-state, microwave signal from input transmission line (101) or Port 1 can only propagate to the second output transmission line (103) or Port 2 but not to the first output transmission line (102) or Port 3. Therefore, a solid line is drawn between Ports 1 and Port 2 to represent a path for the microwave signals, while a broken line is drawn between Port 1 and Port 3 to represent a breakage for the microwave signals. Similarly, when (50') is in Off-state and (50) is in On-state, microwave signal from Port 1 cannot propagate to Port 2 but only to Port 3. Therefore, a solid line is drawn between Ports 1 and port 3 and a broken line is drawn between Port 1 and Port 2 to show the functionality of the switch (100), as shown in FIG. 8(*b*).

Figure 9A:
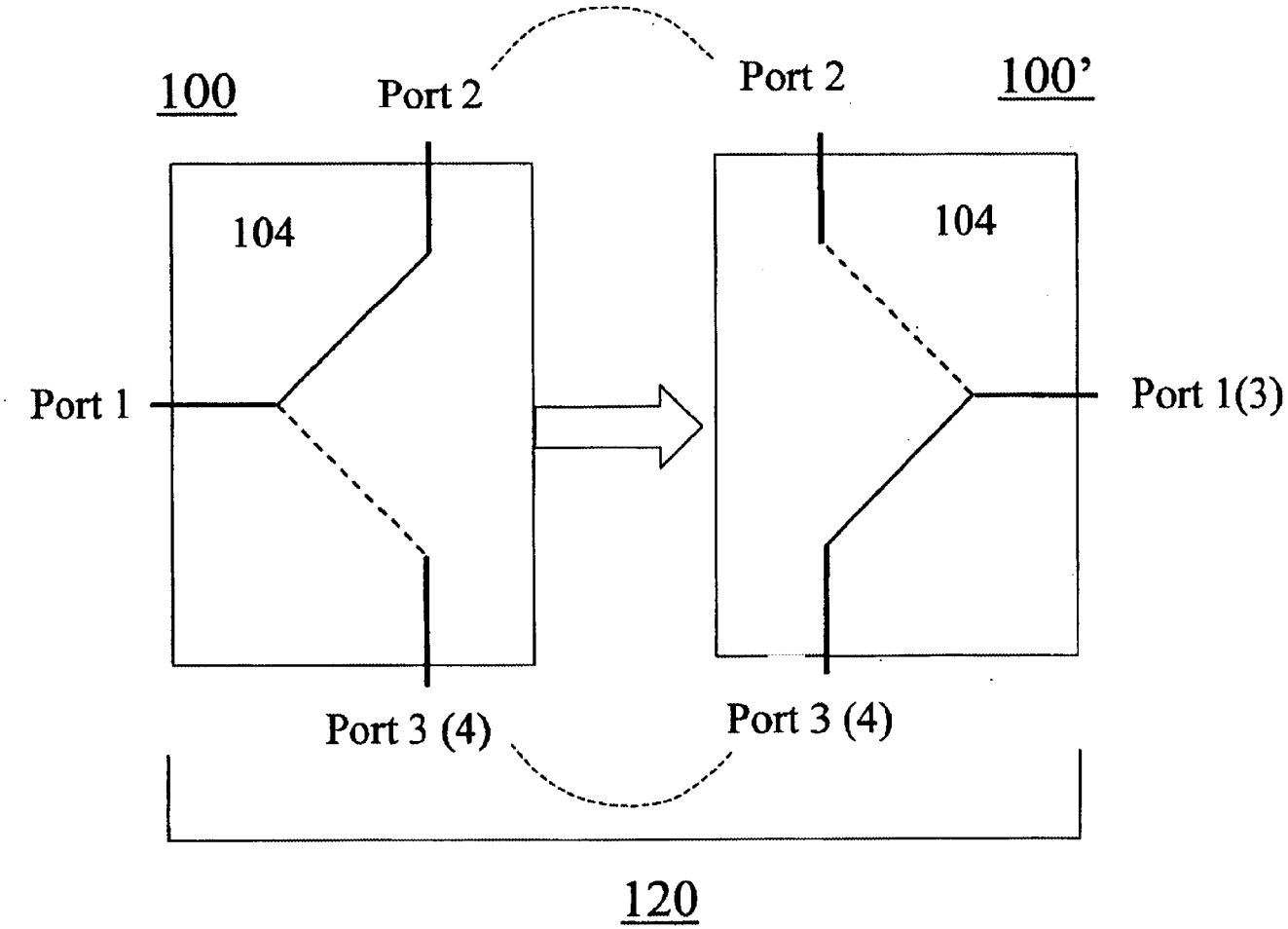
FIG. 9 shows a two-by-two switch array (120) or a C switch constructed using two single-pole-double-throw microwave MEMS switches (100, 100').
Figure 9B:
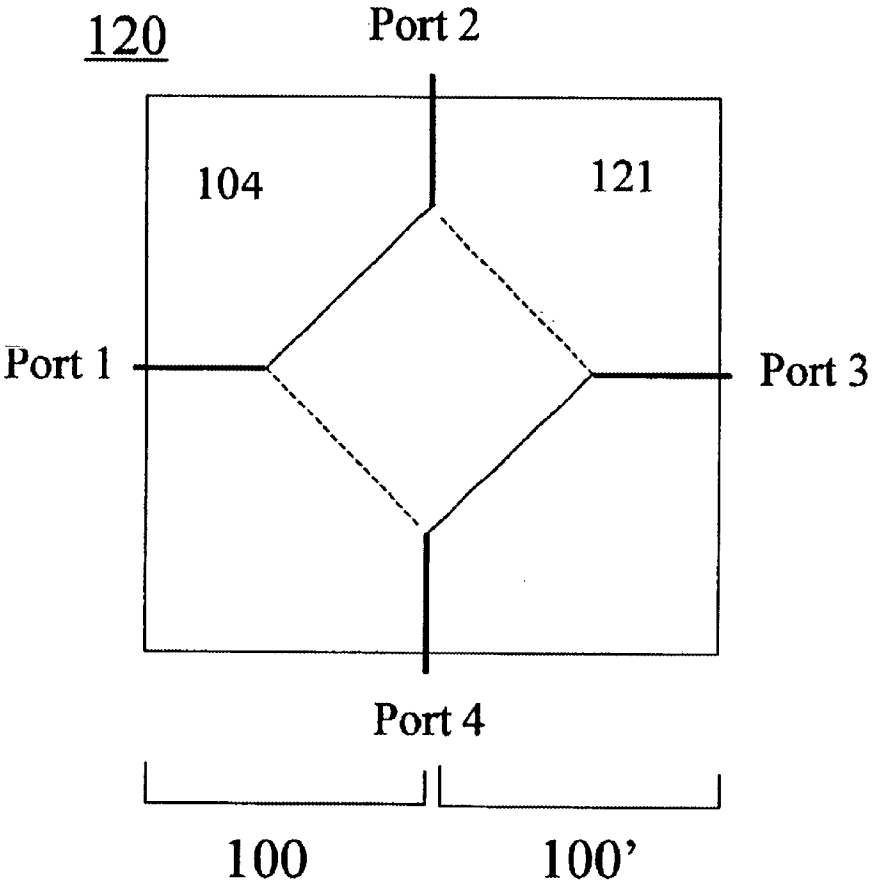
Figure 9C:
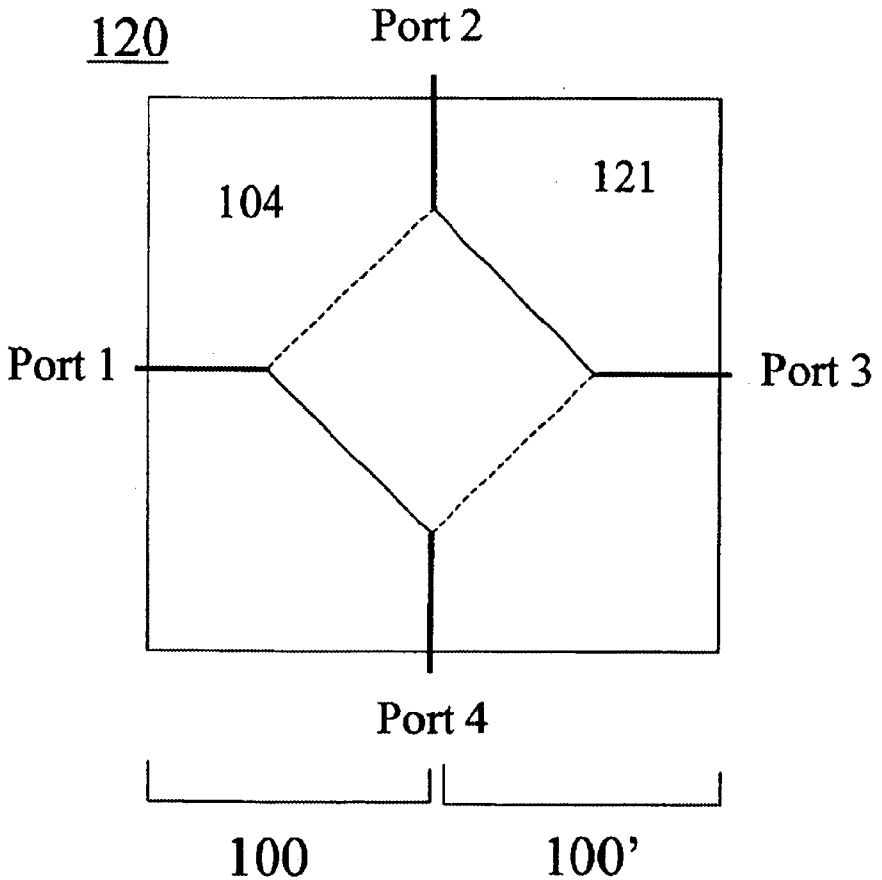

4. Two-by-two RF MEMS Switch Array:

Another example of a microwave switch array in a two-by-two (2×2) switch array (120) or C switch form according to this invention is shown in FIG. 9. It should be mentioned that this example is provided for illustration purposes and not to limit the scope of this invention. This 2×2 switch array (120) consists of two identical electrostatically actuated single-pole-double-throw microwave MEMS switches (100 and 100') with two common ports (Ports 2 and 3) and it can be formed by combining two face-to-face single-pole-double-throw switches (100 and 100') together on a dielectric substrate (104) (see FIG. 9(*a*)).

In FIG. 9 (*b*), the C switch (120) is shown to have four ports (Port 1, 2, 3 and 4). The functionality of the two single-pole-double-throw switches (100 and 100') is represented by four lines (two solid and two broken) between each pair of ports, namely, between Ports 1 and 2, Ports 2 and 3, Ports 3 and 4, and finally between Ports 4 and 1. To simplify the drawing, the actuation electrodes for the four cantilevers are not shown.

When the single-pole-double-throw switch (100) in (120) is switched so that Port 1 is connected to Port 2 and not to Port 4, and the single-pole-double-throw switch (100') in (120) is switched so that Port 3 is connected to Port 4 and not to Port 2, as shown in FIG. 9(*b*), microwave signals from Port 1 can only propagate to Port 2 and will not propagate to Port 4. Similarly, signals from Port 2 can only propagate to Port 1 and will not propagate to Port 3. On the other hand, microwave signals from Port 3 can only propagate to Port 4 and will not propagate to Port 2 and signals from Port 4 can only propagate to Port 3 and will not propagate to Port 1.

When the single-pole-double-throw switch (100) in (120) is switched so that Port 1 is connected to Port 4 and not to Port 1, and the single-pole-double-throw switch (100') in (120) is switched so that Port 3 is connected to Port 2 and not to Port 4, as shown in FIG. 9(*c*), microwave signals from Port 1 can only propagate to Port 4 and will not propagate to Port 2. Similarly, signals from Port 4 can only propagate to Port 1 and will not propagate to Port 3. On the other hand, microwave signals from Port 3 can only propagate to Port 2 and will not propagate to Port 4 and signals from Port 2 can only propagate to Port 3 and will not propagate to Port 1.

To switch a cantilever in the above-described 2×2 switch array from On-state to Off-state and to avoid the switching time delay relying on the spring force or cantilever sticking due to the van der Wall force, a de-actuation device (80) shown in FIGS. 6(*a*) and (*b*) may well be fabricated for each cantilever in the single-pole-double-throw switch (100) and (100') to de-actuate the cantilevers in the above-described 2×2 switch array. In this case, four de-actuation devices may be fabricated on a same second substrate with spacings equal to the spicings between the four cantilevers so that these four de-actuation devices can be aligned over the cantilevers to de-actuate them.

The foregoing description is illustrative of the principles of the present invention. The preferred embodiments may be varied in many ways while maintaining the spirit of this invention. For instance, the single electrostatically actuated microwave MEMS switch with resistive actuation electrodes, the double-throw switches and switch arrays may be fabricated in a form of coplanar waveguide (CPW), striplines or other structures. Furthermore, several 2×2 RF MEMS switch arrays as described above may be combined into more complex switch arrays for switching of microwave signals. Therefore, all modifications and extensions are considered to be within the scope and spirit of the present invention.

The embodiments of the invention in which an exclusive property or privilege is claimed are defined as follows:

1. An electrostatically actuated MEMS switch for microwave and millimeter wave signals with DC to RF isolation and a de-actuation device comprising:

a first dielectric substrate having an input transmission line and an output transmission line deposited on a front surface of said first dielectric substrate, said input transmission line being separated by a gap from said output transmission line along a direction of propagation of said microwave and millimeter wave signals;

a cantilever connected to said input transmission line and with projection overlaps at least a part of said output transmission line;

a first actuation electrode in a form of resistive layer for actuating said cantilever and for DC to RF isolation, with at least a portion being deposited within said gap between said input transmission line and said output transmission line, forming an overlapped portion with said cantilever, said first actuation electrode being connected to a first actuation electrode line having a length and a width;

a second actuation electrode in a form of resistive layer for actuating said cantilever and for DC to RF isolation, with one end connected electrically to said input transmission line, said second actuation electrode being connected to a second actuation electrode line having a length and a width;

a conducting film on said first dielectric substrate forming a ground plane for the propagating microwave and millimeter wave signals; and a second dielectric substrate with a third actuation electrode in a form of resistive layer for de-actuating said cantilever and for DC to RF isolation, having a length and a width and with at least a portion being deposited in region overlapping said cantilever, forming an overlapped portion between said third actuation electrode and said cantilever, said third actuation electrode being connected to a third actuation electrode line having a length and a width.

2. An electrostatically actuated MEMS switch for microwave and millimeter wave signals with DC to RF isolation and a de-actuation device as defined in claim 1, wherein thickness of said first actuation electrode is smaller than thickness of said input transmission line and said output transmission line to minimize interference on the movement of said cantilever.

3. An electrostatically actuated MEMS switch for microwave and millimeter wave signals with DC to RE isolation and a de-actuation device as defined in claim 1, further comprising at least one dielectric stopper deposited on said second dielectric substrate next to said third actuation electrode, wherein thickness of said dielectric stopper is larger than thickness of said third actuation electrode to minimize interference on the movement of said cantilever.

4. An electrostatically actuated MEMS switch for microwave and millimeter wave signals with DC to RF isolation and a de-actuation device as defined in claim 1, further comprising a first dielectric layer deposited on said first actuation electrode and a second dielectric layer on said third actuation electrode to prevent DC shorting between said cantilever and said first actuation electrode when actuated, and between said cantilever and said third actuation electrode when de-actuated.

5. An electrostatically actuated MEMS switch for microwave and millimeter wave signals with DC to RF isolation and a de-actuation device as defined in claim 1, wherein sheet resistance of said first actuation electrode line, said second actuation electrode line and said third actuation electrode line is selected to be greater than the characteristic impedance of said input transmission line and said output transmission line, in order to minimize interference on the propagating microwave or millimeter wave signals.

6. An electrostatically actuated MEMS switch for microwave and millimeter wave signals with DC to RF isolation and a de-actuation device as defined in claim 1, wherein said cantilever is selected from a group of a single metallic layer, a multiple layer structure with at least one metallic layer for the propagating microwave or millimeter wave signals.

7. An electrostatically actuated MEMS switch for microwave and millimeter wave signals with DC to RE isolation and a de-actuation device as defined in claim 1, further comprising a recess region in said cantilever and said recess region being located within overlapping region between projection of said cantilever and said output transmission line to enhance electrical contact between said cantilever and said output transmission line.

* * * * *